US006695068B2

(12) United States Patent
Woodall et al.

(10) Patent No.: US 6,695,068 B2
(45) Date of Patent: Feb. 24, 2004

(54) TEXTILE AND CORDAGE NET FIRE EXTINGUISHER SYSTEM

(75) Inventors: Robert Woodall, Panama City Beach, FL (US); Felipe Garcia, Panama City, FL (US); Christopher Doyle, Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 365 days.

(21) Appl. No.: 09/910,565

(22) Filed: Jul. 23, 2001

(65) Prior Publication Data

US 2002/0050534 A1 May 2, 2002

Related U.S. Application Data

(63) Continuation-in-part of application No. 09/698,663, filed on Oct. 30, 2000, now Pat. No. 6,325,015.

(51) Int. Cl.[7] ..... A62C 2/00

(52) U.S. Cl. ..... 169/47; 169/28; 169/48; 169/49; 169/54; 169/62

(58) Field of Search ..... 169/26, 28, 46, 169/47, 48, 49, 50, 54, 62, 66; 405/60, 63, 66; 442/301, 302, 414; 52/DIG. 12, DIG. 14, 1

(56) References Cited

U.S. PATENT DOCUMENTS 1,679,243 A * 7/1928 Fasul ..... 169/49
5,146,996 A * 9/1992 Gainer, Jr. ..... 169/49
5,407,301 A * 4/1995 Lydiard et al. ..... 405/60
5,423,150 A * 6/1995 Hitchcock ..... 169/48
5,608,992 A * 3/1997 Floyd ..... 52/DIG. 14
5,860,251 A * 1/1999 Gleich ..... 52/DIG. 14
6,125,941 A * 10/2000 Lokken ..... 169/48
6,474,420 B1 * 11/2002 Adiga ..... 169/47

* cited by examiner

*Primary Examiner*—Steven J. Ganey
(74) *Attorney, Agent, or Firm*—Donald G. Peck; Harvey A. Gilbert

(57) ABSTRACT

A rocket propelled textile and cordage net fire extinguishing system is deployed from a platform at a safe standoff distance from a fire. The rocket propelled matrix-like net flies over, lands on, and drapes over the burning site. A detonating means, or detonating network on the net is actuated to rupture spaced-apart canisters on the net that are filled with halon and/or other fire extinguishing compounds. The detonating network quickly disperses the fire extinguishing compounds to engulf and extinguish the fire safely and efficiently without unduly exposing fire fighters to danger. The net fire extinguisher system can extinguish fires aboard a maritime vessel, particularly when the burning craft cannot be safely boarded or burns so fiercely that it cannot be approached closely. The net fire extinguisher system can combat highly dangerous fires including chemical and oil fires, (oil rig fires) on land and at sea.

25 Claims, 6 Drawing Sheets

TEXTILE AND CORDAGE NET FIRE EXTINGUISHER SYSTEM

CROSS REFERENCE TO RELATED APPLICATION

This is a continuation in part of U.S. patent application entitled "System for Arresting a Seagoing Vessel" by Robert Woodall et al., U.S. Patent and Trademark Office Ser. No. 09/698,663 (NC 82550), filed Oct. 30, 2000 now U.S. Pat. No. 6,325,015 and incorporates all references and information thereof by reference herein.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to devices to fight fires. More particularly, the fire extinguisher system of this invention is deployed quickly from a platform at a safe standoff distance from a fire to safely and efficiently suppress it without undue exposure to danger.

Currently, fire fighters are without an effective large-scale system, aside from standard water hoses and helicopter "dump buckets." These systems cannot deploy safely and quickly to effectively suppress fires. Tug boats or water trucks carrying pumps and attached fire hoses are used to combat fire at sea or on land and have met with limited success. This is because relatively small streams of water are pumped onto one or more localized points in the fire zone. These small streams quite often are in insufficient quantities to quickly suppress a raging fire safely and effectively. In addition, often it is extremely dangerous for these firefighting platforms to get very close to the burning sites, and hence, the limited effectiveness of their spraying equipment is further reduced. Because water, related water-based, or water-deployed fire fighting chemicals are usually the only agents available for these contemporary firefighting platforms, more highly effective fire suppressant chemical compounds or materials cannot be brought in sufficient quantities into the fire zone in a timely fashion to suppress fires throughout the complete fire zone.

Thus, in accordance with this inventive concept, a need has been recognized in the state of the art for a rocket deployed, textile and cordage supported fire extinguisher system to safely, and effectively combat large-scale fires with huge payloads of fire fighting compounds.

SUMMARY OF THE INVENTION

The present invention provides a system to suppress fires at a burning site. A matrix-like net structure is connected to frangible canisters of fire extinguishing compounds connected to a detonating network of pyrotechnic elements. Rockets connected to the net structure pull it from a platform, fly it to and over a nearby burning site, and drape the net over the site. Activation of the detonating network ruptures the canisters and disperses the fire extinguishing compounds to extinguish the fire.

An object of the invention is to provide a system for safely extinguishing a fire at a burning site from a nearby launch platform.

Another object is to provide a system for extinguishing a highly dangerous fire with significant quantities of fire extinguishing compounds safely and effectively.

Another object is to provide a system for extinguishing fires having net structure supporting canisters of fire extinguishing compounds dispersed by pyrotechnics.

Another object is to provide a system for extinguishing fires having rockets deploying net structure supporting many canisters of fire extinguishing compounds that flies to and drapes over a burning site.

Another object is to provide a system for extinguishing fires having net structure supporting many canisters of fire extinguishing compounds that flies to and drapes over a burning site to disperse the chemicals by activated pyrotechnics to suppress the fire.

Another object is to provide a method of packing a matrix-like net supporting canisters of fire extinguishing compounds and a detonating network that assures reliable deployment from a launch platform to a burning site to extinguish a fire.

These and other objects of the invention will become more readily apparent from the ensuing specification when taken in conjunction with the appended claims.

DESCRIPTION OF THE PREFERRED EMBODIMENT

Figure 1:
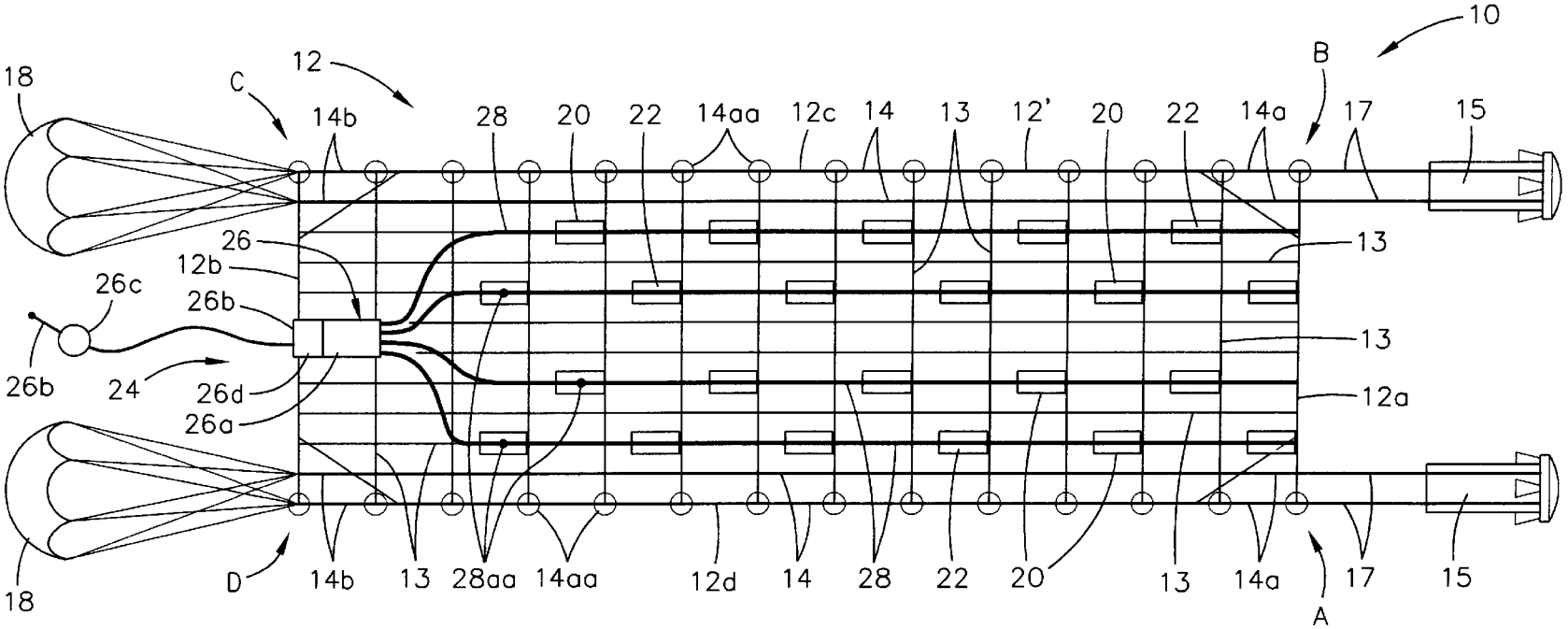
FIG. 1 shows a schematic top view of the fire fighting system of the invention during deployment.
Figure 1A:
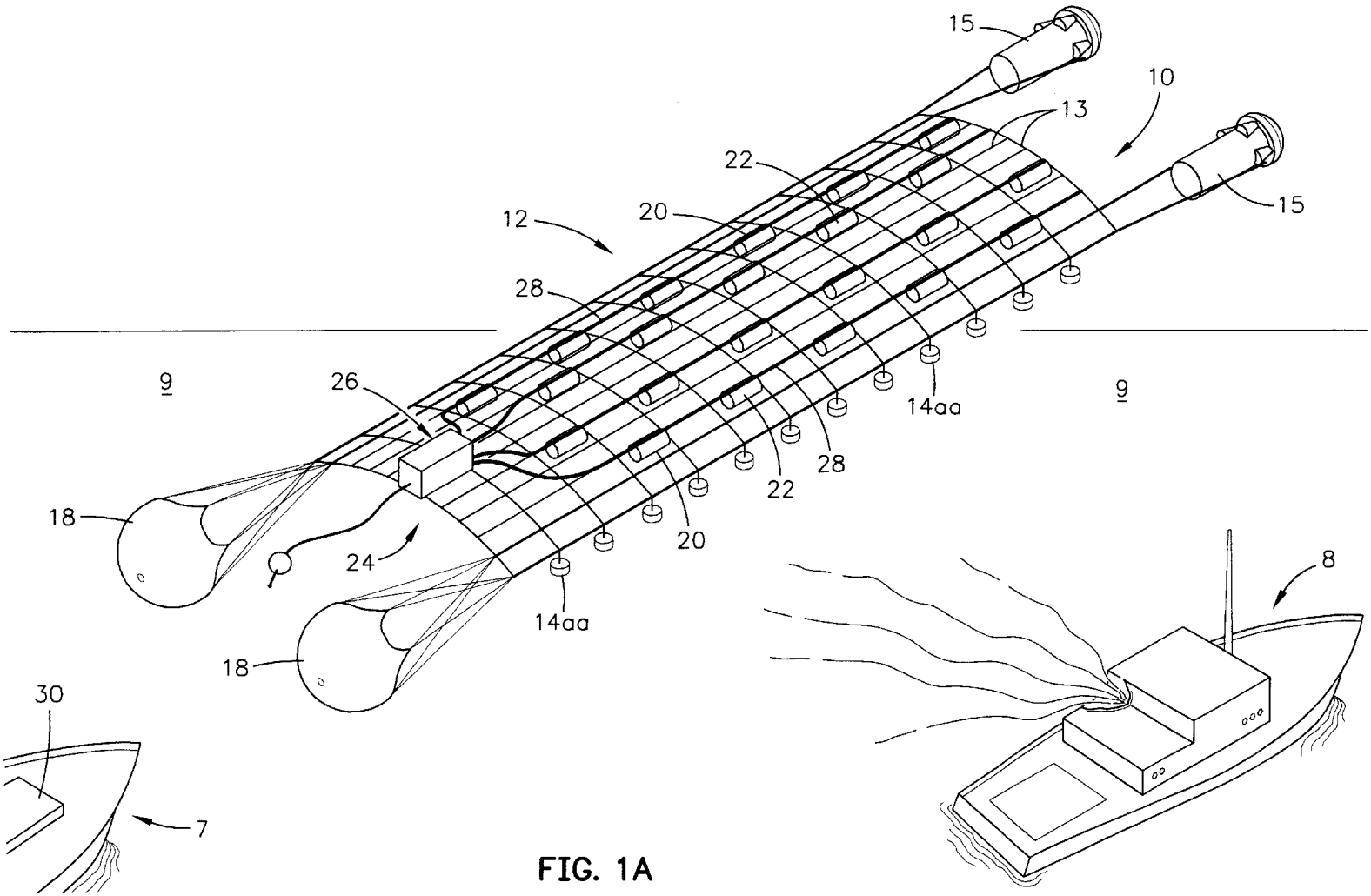
FIG. 1*a* shows an isometric top-view of the fire fighting system of the invention during deployment over a burning marine vessel.

Referring to FIGS. 1 and 1A, fire-fighting system 10 is depicted during flight from a launch platform 7 (a fire boat) and to and over a burning site 8 (a burning marine vessel) on the surface of the ocean 9. Fire fighting system 10 of this invention is a highly effective means to stop a fire under hazardous conditions, such as offshore disasters where a burning oil rig or maritime vessel cannot be boarded or when it is unsafe for fire fighting equipment and/or personnel to be in close proximity to fight the fire. System 10 additionally can be used to extinguish chemical or other dangerous fires on land.

Fire fighting system 10 has a net 12 made of a matrix of flexible lengths 13 of textile and cordage appropriately tied and/or otherwise interconnected together within the boundaries of a perimeter 12' having a leading edge 12a and trailing edge 12*b* and a first side edge 12*c* and second side edge 12*d*. Matrix-like net 12 also includes flexible elongate strength members 14 that longitudinally extend along opposite sides of net 12 at first side edge 12*c* and second side edge 12*d* and are connected to flexible lengths 13 of textile and cordage. A plurality of frangible canisters 20 is secured to flexible lengths 13 of textile and cordage of net 12 in a spaced-apart relationship virtually throughout the length and width of net 12. Each frangible canister 20 is filled with fire extinguishing compound 22 that could be water, halon and/or other liquid, granular, or powdered solid material chemical compound, or gaseous chemical compounds or compositions to extinguish or otherwise suppress a fire. Net 12 additionally supports an interconnected detonating network, or detonating means 24 including at least one fuze 26 connected to flexible detonating lines 28 that each extends and connects to a number of canisters 20. Actuation of fuze 26 causes detonating network 24 to activate all detonating lines 28 which rupture and fragment all canisters 20, and all fire extinguishing compound 22 of canisters 20 is virtually simultaneously released and dispersed throughout the area of a burning site inside of and nearby perimeter 12' of net 12.

Strength members 14 are secured via leading ends 14*a* at leading edge 12*a* of net 12 to tow lines 17 extending to rockets 15 and via trailing ends 14b at trailing edge 12*b* of net 12 to drogue chutes 18. Strength members 14 are made from strong cords, or lines, such as wire cables, nylon, or the materials marketed under the trademark KEVLAR by E. I. DuPont Inc., 1007 Market Street, Wilmington Del. 19898 and SPECTRA by Honeywell Inc., P.O. Box No. 2245, Morristown, N.J. 07962. Strength members 14 provide structural integrity and bear the load of net 12, canisters 20, compound 22, detonating network 24, and drag of entrained air and slipstream in drogue chutes 17. This load is created when rockets 15 pull these constituents of system 10 from a box-like stowage container 30 on a launch platform 7 (see also FIGS. 6 and 7) during launch, or deployment of system 10 and fly them over the burning marine vessel of burning site 8. In addition to having sufficiently strong strength members 14 at opposite sides of net 12, the interconnected lengths 13 of textile and/or cordage of net 12 also are made from various kinds of textile material tied or otherwise connected together where they cross each other to create a matrix-like pattern within perimeter 12'. Lengths 13 have sufficient strength to bear at least some portions of this load created during launch and flight of system 10. Accordingly, net 12 stays intact and holds together while it flies to and drapes over burning site 8 to keep its associated components (the spaced-apart canisters 20 of fire extinguishing compound 22 and detonating network 28) positioned for effective fire suppression. Strength members 14 are provided with a spaced-apart weights 14*aa* along side edges 12*c* and 12*d* (and optionally, although not shown, along edges 12*a* and 12*b* ) to help the sides of net 12 drape downward along the sides and over a burning site just prior to detonation of detonating lines 28.

Rockets 15 are two high-payload rocket motors providing sufficient thrust to pull these constituents of system 10 from container 30 on launch platform 7, fly them across the safe-separation distance between launch platform 7 and burning site 8, and land-and-drape them over burning site 8. Rockets 15 have the right amount of thrust to fly the constituents of system 10 for the duration of transit across the safe-separation distance between launch platform 7 and burning site 8 and then turn off, or burn out to place the constituents of system 10 in a position that covers and drapes over burning site 8. Next, fuze 26 is actuated by an interconnected subsystem 26*a* in fuze 26 either autonomously after a delay or upon receipt of an RF OR ELF to VLF command signal from launch platform 7.

Fuzing subsystem 26*a* of fuze 26 is connected to an antenna 26*b* on a float 26*c* to receive detonation control signals from launch platform 7 to effect activation, or detonation of pyrotechnic power elements of detonating lines 28. An example of a suitable fuze subsystem 26*a* in fuze 26 is disclosed in U.S. patent application No. 09/228,074, filed Jan. 5, 1999 (Navy Case 78802), and entitled "Magneto Inductive On-Command Fuze," and a timer circuit 26*d* also can be included in fuzing subsystem 26*a* of fuze 26 to effect activation of detonating lines 28 after a predetermined delay. Other suitable subsystems receiving control signals from remote sources to detonate components form fuze 26 could be used. Detonating lines 28 of system 10 can be in accordance with the design of several contemporary pyrotechnic power elements.

When detonating lines 28 are electrical leads each connected to explosive squibs 28*aa* inside of each canister 20, actuated fuze 26 sends appropriate signals over them to detonate explosive squibs 28*aa,* see FIG. 1. This fragments canisters 20 and disperses the liquid, powered, or gaseous forms of fire fighting compound 22 from fragmented canisters 20. When detonating lines 28 connected to fuze 26 are explosive detonating cords 28', see FIGS. 2 and 3, or explosive flexible linear shaped charges 28", see FIGS. 4 and 5, the exploding detonating cords 28' or flexible linear shaped-charges 28" rupture, or fragment canisters 20 and disperse the liquid, powered, or gaseous forms of firefighting compound 22 around the fire to extinguish it. An example of a suitable detonating cord 28' for detonating line 28 is disclosed in U.S. patent application No. 09/215,923, filed Dec. 10, 1998 (NC 79294), and entitled "High Output Insensitive Munition Detonating Cord."

Figure 2:
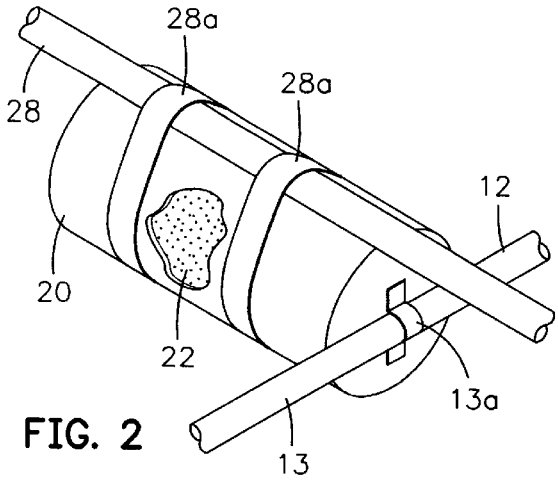
FIGS. 2, 3, 4, and 5 show exemplary arrangements of canisters containing fire extinguishing compound and components of a detonating network mounted on textile cordage of the net.
Figure 3:
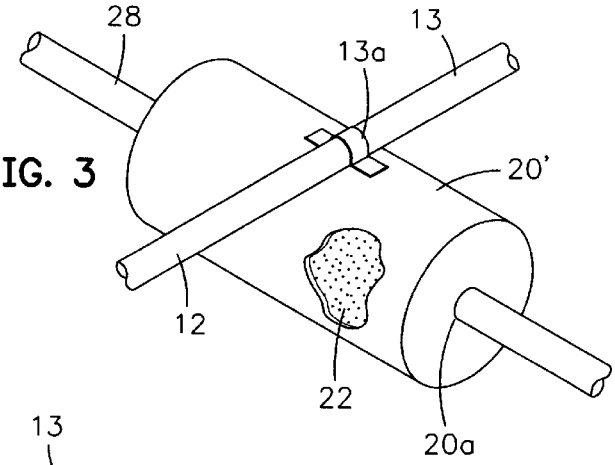
Figure 4:
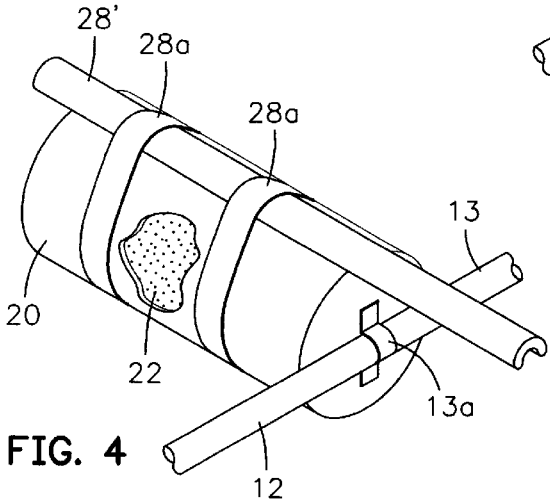
Figure 5:
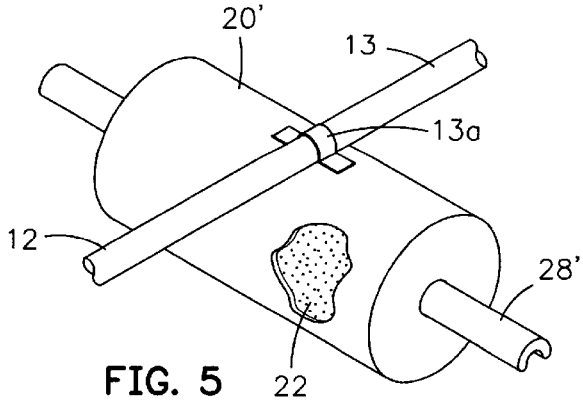

FIG. 2 additionally shows detonating line 28 being explosive detonating cord 28" connected to a cylindrically-shaped canister 20 of liquid, powdered, or gaseous forms of fire extinguishing compound 22 by ring-shaped clamps 28*a,* and canister 20 is connected at its end to cordage 13 of net 12 by clamp 13*a*. FIG. 3 additionally depicts detonating cord 28' of detonating line 28 extending through and retained, or secured in an axial longitudinal opening 20*a* in a tubular-shaped canister 20'. Canister 20' can be filled with liquid, powdered, or gaseous form of fire extinguishing compound 22, and it is connected on its outer rounded surface to cordage 13 of net 12 by clamp 13*a*. Detonation of detonating cord 28' fragments canisters 20 and 20' and effectively disperses fire fighting compound 22 to extinguish a fire. FIG. 4 additionally shows detonating line 28 being an explosive elongate flexible linear shaped-charge 28" of explosive material connected to a cylindrical-shaped canister 20 of fire extinguishing compound 22 by ring-shaped clamps 28*a,* and canister 20 is connected at its end to cordage 13 of net 12 by clamp 13*a*. When flexible linear shaped-charge 28" is detonated, it directs a linear high-energy, focused, shock wave of expanding gases along its length, similar to the point of high-energy point expanding gases generated by a conventional shaped-charge, to ensure fragmentation of canisters 20 and dispersion of fire extinguishing compound 22. In FIG. 5 additionally shows flexible linear shaped charge 28" of detonating line 28 extending through and being retained, or secured in an axial longitudinal opening 20*a* in a tubular-shaped canister 20'. Canister 20' can be filled with liquid, powdered, or gaseous forms of fire extinguishing compound 22, and it is connected on its outer rounded surface to cordage 13 of net 12 by clamp 13*a*. The components and interconnections of FIGS. 2, 3, 4, and 5 are meant to be exemplary and can be readily modified to accommodate materials at hand and different operational requirements. Having the teachings disclosed herein one skilled in the art can select many other suitable components and arrangements within the scope of the invention.

Figure 6:
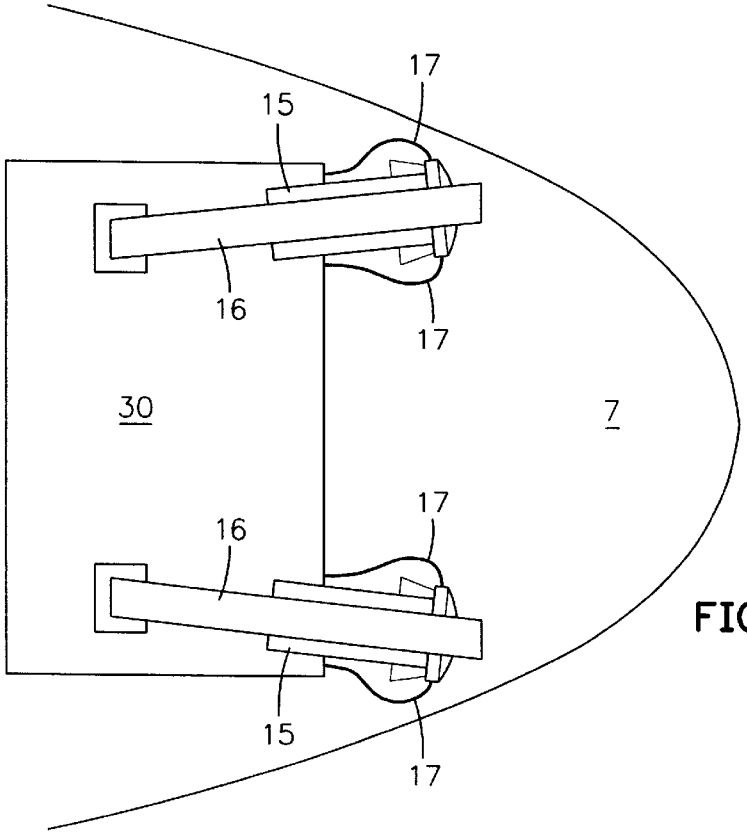
FIGS. 6 and 7 are a top view and side cutaway view of a container mounted on a launch platform, and the net and canisters of fire extinguishing compound connected to rockets and packed in the container.
Figure 7:
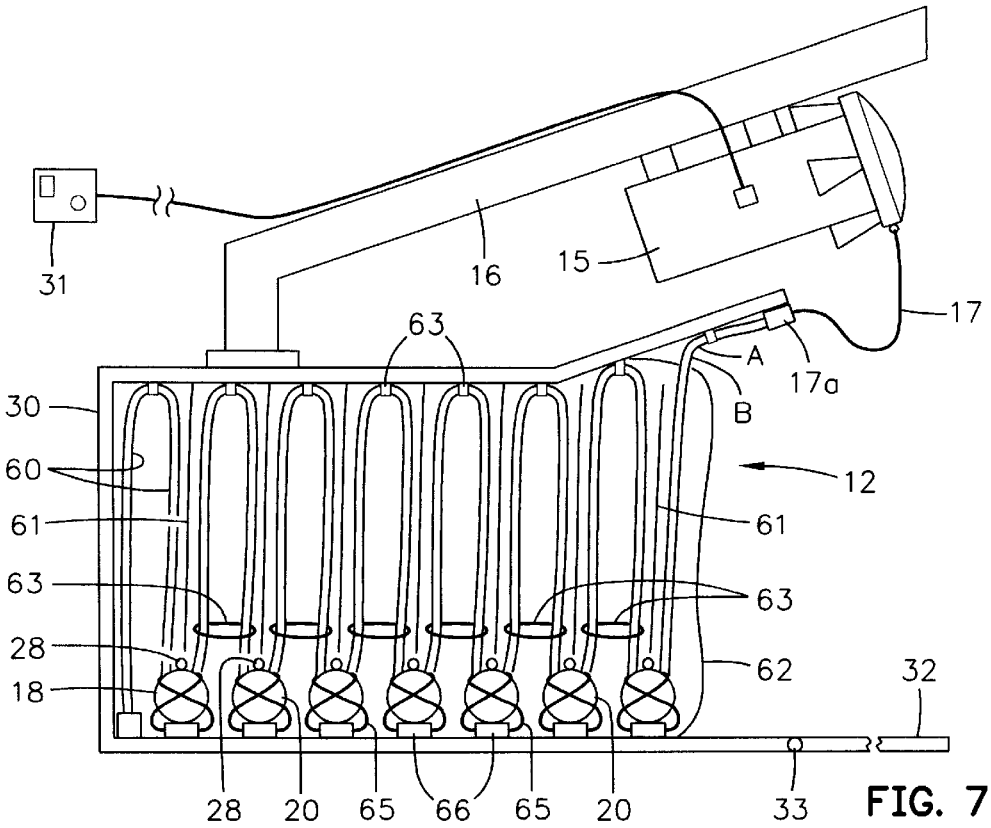

Referring also to FIGS. 6 and 7, fire extinguisher system 10 has a container 30 mounted on launch platform 7 that might be an oceangoing vessel. Two rockets 15 are mounted in launch racks 16 on container 30 and have short lengths of tow line 17 that are connected via connectors 17*a* to reinforced forward corners A and B of net 12 stowed in container 30. As shown in FIG. 7, net may be folded in such a fashion, such as by the methods described below, to locate canisters 20 of fire extinguishing compound 22 and detonating network 28 inside and at the bottom of container 30 to reduce the possibility of damaging canisters 20 and detonating network 28 or deforming the folded net 12 and/or creating obstacles that might otherwise impede and/or snag net 12 as it is being deployed. When rockets 15 receive a launch signal from a fire control 31 on launch platform 7, rockets 15 are launched from launch racks 16, and tow lines 17 pull reinforced corners A and B on net 12. A cover 32 of container 30 is rotated about hinge 33 to allow rockets 15 to pull matrix-like net 12 and its associated components from container 30.

Launch racks 16 are aimed to point rockets 15 upward and away from launch platform 7 and toward burning site 8. This longitudinally extends net 12 and its associated components mounted on it to full longitudinal extension of net 12 as they fly to burning site 8. Launch racks 16 are oriented with respect to each other to point, or aim rockets 15 in directions that slightly diverge from one another by a few degrees. This divergence assures that net 12 and its associated components mounted on it are laterally spread-out to full lateral extension of net 12 by the time rockets 15 pull them to the area of burning site 8. Deployed in this manner, net 12 and its supported components can cover and drape over the area of the burning site. When detonating network 24 is actuated to fragment canisters 20 and disperse fire-extinguishing compound 22 from fragmented canisters 20, the fire at burning site 8 is extinguished.

Figure 8:
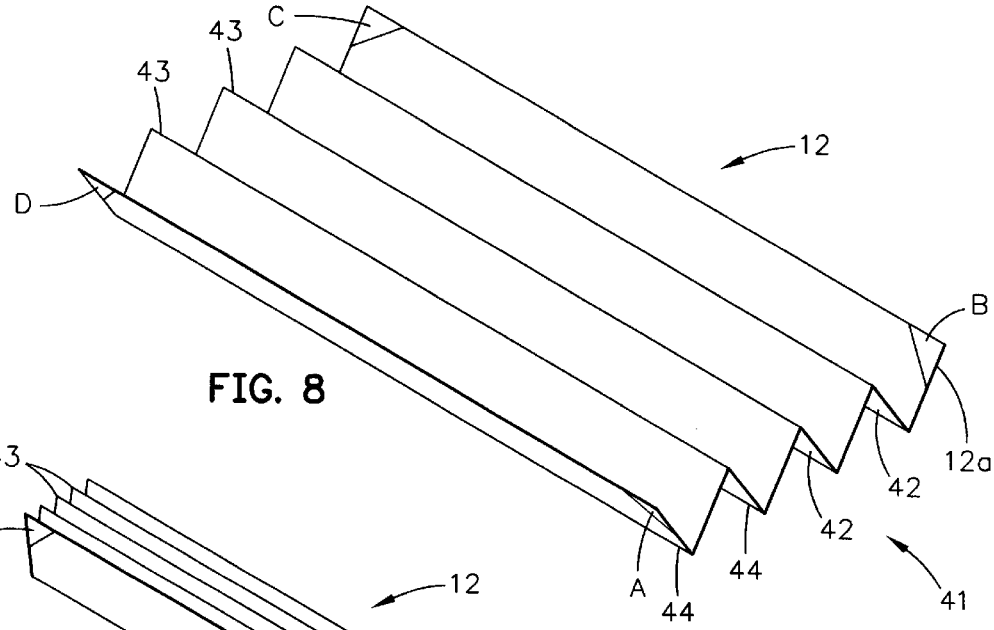
FIG. 8 schematically depicts the step of longitudinally folding a matrix-like net in a series of longitudinally extending strips between top and bottom longitudinal folds of a first method of folding and packing the net having canisters of fire extinguishing compound and a detonating network mounted thereon in a stowage container.
Figure 9:
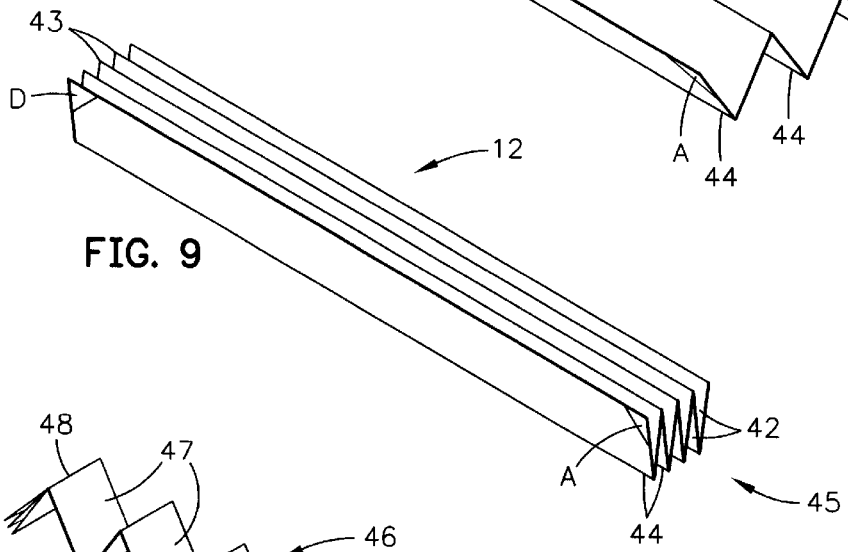
FIG. 9 schematically depicts the step of stacking the longitudinally extending strips and the top and bottom longitudinal folds to lie adjacent one another of the first method.
Figure 10:
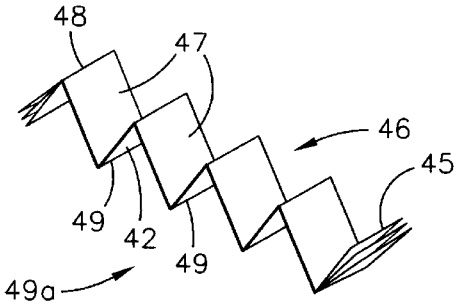
FIG. 10 schematically depicts the step of laterally folding the stacked longitudinal strips and top and bottom longitudinal folds to create a series of laterally extending laterally folded strips between top and bottom lateral folds of the matrix-like net of the first method.

Fire extinguishing system 10 can be packed by two volumetrically efficient and relatively uncomplicated packing methods that ensure reliable dynamic deployments to burning sites. A first method of packing has matrix-like net 12 and its associated components (canisters 20 of fire extinguishing compound 22 and detonating network 24) placed on a flat surface. Forward corners A and B at leading edge 12*a* of net 12 have been reinforced for connection to tow lines 17 extending to rockets 15. The exemplary net 12 is longer in a longitudinal dimension than a lateral dimension; however, differently proportioned net structures can be made and folded as disclosed herein. Referring to FIG. 8, matrix-like net 12 is schematically shown as longitudinally folded along the longitudinal extension of net 12 to create a series 41 of longitudinally extending strips 42 between top and bottom longitudinal folds 43 and 44. Referring to FIG. 9, successive ones of longitudinal folds 43 and 44 are schematically shown as formed in net 12 by successively rotating net 12 in opposite rotational directions about each longitudinal fold to place strips 42 between folds 43 and 44 lying adjacent to one another in an accordion-like longitudinally extending stack 45. Referring to FIG. 10, now stack 45 of longitudinal strips 42 and longitudinal folds 43 and 44 is schematically shown as being rotated ninety degrees around the longitudinal extension, or axis of stack 45 to lie on an outer one of strips 42 and be laterally folded along the lateral extension of net 12 to create a series 46 of laterally extending folded strips 47 between top and bottom lateral folds 48 and 49 of net 12. Successive ones of top and bottom lateral folds 48 and 49 are formed in net 12 by successively rotating net 12 in opposite rotational directions about each lateral fold to place lateral strips 47 and top and bottom lateral folds 48 and 49 of series 46 lying adjacent to one another in an accordion-like laterally extending stack 49*a*.

Figure 11:
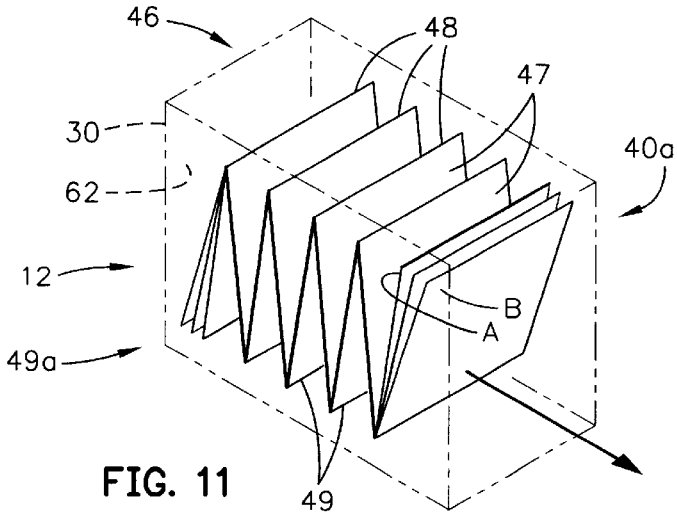
FIG. 11 schematically depicts the step of fitting the series of laterally extending laterally folded strips of the matrix-like net and its associated components together into a compact folded package in the container of the first method.

Referring to FIG. 11, stack 49*a* of series 46 of laterally extending folded strips 47 between top and bottom lateral folds 48 and 49 of net 12 and its associated components is schematically shown pressed, or fitted together into a compact package 40*a* that is packed into container 30. Reinforced corners A and B of leading edge 12*a* of net 12 are located to be at the top of package 40*a* to connect to tow lines 17 from rockets 15, and cover 32 now may be rotated shut. Canisters 20 and detonating network 28 may be located on net 12 to place them to rest on container 30 when net 12 is folded.

Figure 12:
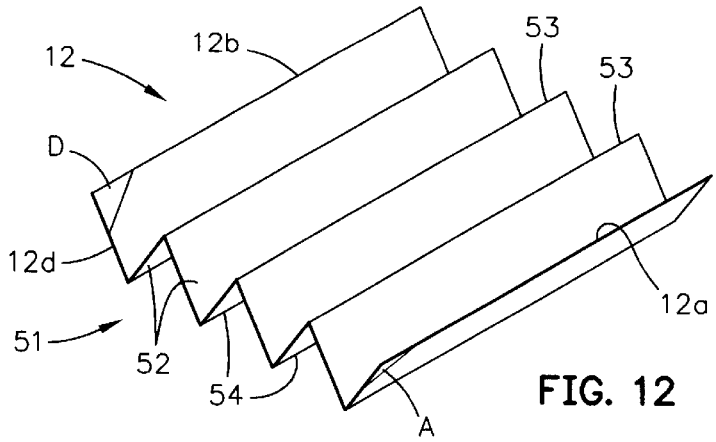
FIG. 12 schematically depicts the step of laterally folding a matrix-like net in a series of laterally extending strips between top and bottom lateral folds of a second method of folding and packing the net having canisters of fire extinguishing compound and a detonating network mounted thereon in a stowage container.
Figure 13:
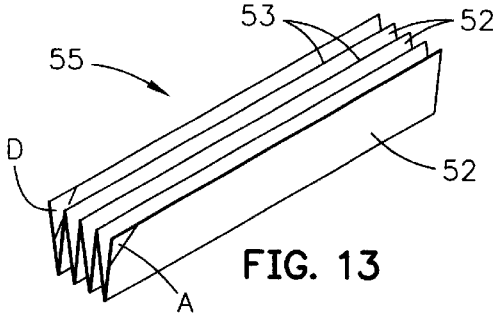
FIG. 13 schematically depicts the step of stacking said laterally extending strips and said top and bottom lateral folds to lie adjacent one another of the second method.
Figure 14:
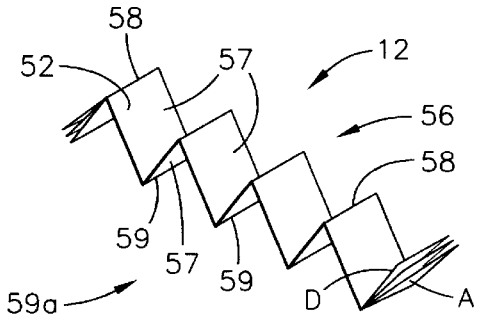
FIG. 14 schematically depicts the step of longitudinally folding the stacked lateral strips and top and bottom lateral folds to create a series of longitudinally extending longitudinal folded strips between top and bottom longitudinal folds of the matrix-like net of the second method.

A second method of packing net 12 also requires that net 12 and its associated components be laid out on a flat surface and that forward corner A on leading edge 12*a* and rear corner D on trailing edge 12*b* have been reinforced for connection to tow lines 17 extending to rockets 15. Like the method disclosed above, the exemplary net 12 is longer in a longitudinal dimension than a lateral dimension. Referring to FIG. 12, matrix-like net 12 is schematically shown as laterally folded along the lateral extension of net 12 to create a series 51 of laterally extending strips 52 and top and bottom lateral folds 53 and 54. Referring to FIG. 13, successive ones of folds 53 and 54 are schematically shown as formed in net 12 by successively rotating net 12 in opposite rotational directions about each lateral fold to place strips 52 and folds 53 and 54 lying adjacent to one another in an accordion-like longitudinally extending stack 55. Referring to FIG. 14, now, stack 55 of strips 52 and folds 53 and 54 is schematically shown rotated ninety degrees about the lateral extension, or axis to lie on an outer one of strips 52 and be longitudinally folded along the longitudinal extension of net 12 to create a series 56 of longitudinally extending folded strips 57 between top and bottom longitudinal folds 58 and 59 of net 12. Successive ones of folds 58 and 59 are formed in net 12 by successively rotating net 12 in opposite rotational directions about each longitudinal fold to place strips 57 and folds 58 and 59 of series 56 lying adjacent to one another in an accordion-like longitudinally extending stack 59*a*.

Figure 15:
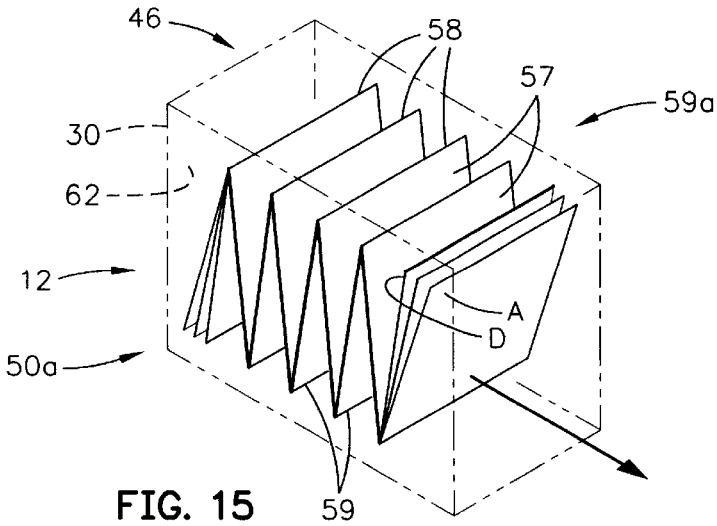
FIG. 15 schematically depicts the step of fitting the matrix-like net and its associated components together into a compact folded package in the container of the second method.

Referring to FIG. 15, stack 59*a* of series 56 of net 12 and its associated components is schematically shown as pressed, or fitted together into a compact package 50*a*, see FIG. 15. Package 50*a* is packed in container 30 to place reinforced corners A and C on edge 12*c* of net 12 at the top of packing to connect to tow lines 17 from rockets 15 and cover 32 may be rotated shut on container 30. Like the packing of the first method, canisters 20 and detonating network 28 may be located on net 12 to place them to rest on container 30 when net 12 is folded.

Using the second packing scheme will result in net 12 and its associated components being deployed sideways to cover a wider yet shallower area as compared to the deployment of net 12 in FIGS. 1 and 1*a*. In other words, using the second packing method of net 12 and its associated components will cause net 12 to be deployed from container rotated ninety degrees about a vertically extending axis as compared to the deployment shown in FIGS. 1 and 1*a*. Edge 12*d* of net 12 will be the leading edge of net and edge 12*c* will be the trailing edge. Drogue chutes 18 may be coupled to corners B and C and weights 14*aa* along edges 12*c* and 12*d* may be supplemented with weights 14*aa* distributed along edges 12*a* and 12*b*, (not shown). In addition, the references to the terms top and bottom with respect to the description of the two packing methods are for the purposes of explanation. That is to say, the designations top and bottom could have been left and right without the ninety-degree rotations of net 12 after it had been folded. Other different and distinguishable terms might have been used to demonstrate the relationships of different folds to net 12 and/or one another.

Referring to FIG. 7, in addition to packing net 12 and its associated components by the first and second folding and packing methods described above, a dry coating 60 can be included on each layer of the folded net 12 of system 10. Talcum powder or other friction reducing means might be used as coating 60 to eliminate layer-to-layer sticking of stacked layers prior to and during deployment of system 10. Sheet-layers 61 of thin low friction (surface energy) polymers and/or other powdered friction reducing materials can also be placed between each layer of the folded net 12 of system 10 to keep fabric/cordage constituents from sticking to one another. A thin and frangible polymeric bag 62 may surround the folded net 12 and associated components of system 10 and be vacuum packed to ensure that more efficient volumetric packaging is created that does not interfere or hinder the reliable unfolding and deployment of system 10.

Optionally, each layer of net 12 and its associated components of system 10 may be held together and/or to container 30 by small frangible thread/cordage elements 63 connecting each successive fold to the next. Upon deployment by rockets 15 and subsequent tensile loading, thread/cordage elements 63 sequentially break reliably and consistently at predetermined levels of force during deployment to release the folded and layered net 12 and associated components of system 10 in the proper sequential timing and order. This sequential breaking can be controlled by using different pieces for thread/cordage elements 63 that have different strengths to hold successive layers of the folded structure together. Opening the folded net 12 and associated components of system 10 therefore occurs in a preferred fashion; i.e., back to front, front to back, center to front, and center to back, etc. to most effectively deliver fire extinguishing compounds on a fire.

Another option is to connect each successive layer together with a substantial reefing line 65 that is connected to an aerospace quality reefing line cutter 66 on container 30. Cutter 66 contains a highly reliable delay actuator 67, such that the release timing and order of each layer of the folded system 10 can be accurately and precisely controlled to yield a more reliable and effective timing and trajectory during deployment of system 10. The time delays of each reefing line cutter 66 can be tailored to a desired timing sequence. Such reefing line cutters 66 and delay actuators 67 are currently manufactured using proprietary processes by Roberts Research Laboratory located in Torrance Calif. Whichever method of packing is selected, the optional connections of cordage elements 63, reefing lines 65 and reefing line cutters 66 for net 12, fuze 26, canisters 20, and detonating lines 28 can be appropriately attached to the folded system 10, see FIG. 7.

Irrespective which method of packing is chosen, when rockets 15 are actuated and start to fly toward the burning site, tow lines 17 pull reinforced corners A and B from container 30. The rest of net 12 and canisters 20 of fire extinguishing compound 22 follow in close order out of container 30, spread out as they fly to and over the burning site, and drape over it as rockets 15 burn out. System 10 is deployed in a rectangular-shape the size of net 12 that effectively covers a burning site in an area that has a greater depth as compared to its width. Timely actuation of detonating network 24 assures fragmentation of canisters 20 and effective dispersion of fire extinguishing compound to quickly put out the fire in this area.

Another option is that system 10 can be ejected from container 30 and deployed en mass. That is, the entire packaged net 12 and associated components of system 10 can fly out of container 30. The entire folded package can fly downrange a considerable distance by rockets 15 and then, at a predetermined time, the folded package is opened in a preferred prescribed sequence such as by selectively breaking cordage elements to deploy over the selected target as described before using reefing line cutters 66 and/or small frangible thread/cordage elements 63. Net 12 and its associated components of system 10 can suppress fire on land as well as at sea, can be used to suppress fire aboard moving vehicles, and put out tank fires and oil rig fires. System 10 is scalable.

One size of system 10 deployed a payload of 2,450 pounds and covered an area of 180 feet by 240 feet. It was launched from a standoff position about 1,000 feet away from a fire zone at an average speed of approximately 100 feet/second. If a shorter standoff distance were acceptable (safe), this particular system 10 could be reconfigured accordingly for a corresponding increase of payload, (about a maximum predicted payload of 9,800 pounds) when using same rocket motors that were used for the 1000-foot standoff. Other rocket motors, payload densities (payload weights/areas), and standoff distances are doable, depending on the target area of the intended fire zone, the efficiency of the fire fighting payload, etc. A nearly infinite variety of payloads, deployments and net-opening sequences may be done.

Having the teachings of this invention in mind, different applications, modifications and alternate embodiments of this invention may be adapted. System 10 can be suitably scaled to effectively fight fires of different sizes and severities such as violently out of control oilrig disasters, for example. Different fire extinguishing compounds, including explosives to effectively fight violent fires can be included as a matter of choice. Optionally, net 12 could be made from a sheet of fabric that defines a matrix for supporting canisters 20, detonating network 24 and other components. Although use of explosive squibs 28*aa,* explosive detonating cord 28' and flexible linear shaped charge 28" have been mentioned, other pyrotechnic power elements could be used, including shielded mild detonating cord (SMDC), shock tube initiators, and detonators. System 10 also provides for safe suppression of fires on land in developed or populated areas. A plurality of similar or modified nets 12 and their associated components could be deployed from a plurality of containers 30 simultaneously or sequentially as needed.

The disclosed components and their arrangements as disclosed herein all contribute to the novel features of this invention. System 10 of this invention is a quickly deployable and effective means to safely extinguish fires from a distant launch platform without exposing personnel and equipment to undue danger. Therefore, system 10, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

We claim:

1. A system for extinguishing fire comprising a net having frangible canisters of fire extinguishing compound mounted in a spaced-apart relationship thereon and a detonating means connected to said canisters to rupture said canisters and disperse said fire extinguishing compound.

2. A system according to claim 1 further comprising rockets connected at a leading edge of perimeter of said net and drogue chutes connected at a trailing edge of said perimeter of said net to deploy said net from a launch platform spaced a safe separation distance from a burning site.

3. A system according to claim 2 wherein said interconnected rockets, net, and drogue chutes fly and extend said net and canisters of fire extinguishing compound from said launch platform to cover and drape said net and canisters of fire extinguishing compound over said burning site.

4. A system according to claim 3 wherein said net and canisters of fire extinguishing compound cover and drape over said burning site to extinguish a fire at said burning site with said dispersed fire extinguishing compound from said ruptured canisters.

5. A system according to claim 4 wherein said detonation means is a detonating network that includes a fuze coupled to detonating lines extending to said canisters.

6. A system according to claim 5 wherein said fuze is connected to an antenna on a float to receive detonation control signals from said launch platform to effect activation of said detonating lines.

7. A system according to claim 6 wherein said detonating lines are explosive detonating cords.

8. A system according to claim 7 wherein said canisters are cylindrically-shaped and have said detonating cords clamped thereto.

9. A system according to claim 7 wherein said canisters are tubular-shaped and have said detonating cord extending through an axial opening.

10. A system according to claim 6 wherein said detonating lines are explosive flexible linear shaped-charges.

11. A system according to claim 8 wherein said canisters are cylindrically-shaped and have said flexible linear shaped-charges clamped thereto.

12. A system according to claim 8 wherein said canisters are tubular-shaped and have said flexible linear shaped-charges extending through an axial opening.

13. A system according to claim 6 wherein said detonating lines are electrical leads connected to explosive squibs in said canisters.

14. A system for extinguishing fires comprising:

means for extending a flexible matrix means;

a plurality of means mounted on said flexible matrix means for containing fire extinguishing compound therein, said plurality of containing means being disposed on said flexible matrix means in a spaced-apart relationship from one another;

means connected to said flexible matrix means for deploying it through the air to a burning site; and means for rupturing said containing means and for dispersing said fire-extinguishing compound at said burning site.

15. A system according to claim 14 further comprising:

means connected to said deploying means for spreading said flexible matrix means during deployment thereof by said deploying means to permit covering and draping of said flexible matrix means over said burning site.

16. A system according to claim 15 wherein said dispersed fire extinguishing compound puts out the fire at said burning site.

17. A system according to claim 16 wherein said rupturing and dispersing means is comprised of electrical leads connected to explosive squibs in each of said fire extinguishing compound containing means.

18. A system according to claim 16 wherein said rupturing and dispersing means is comprised of explosive detonating cords connected to each of said fire extinguishing compound containing means.

19. A system according to claim 16 wherein said rupturing and dispersing means is comprised of explosive linear shaped-charges connected to each of said fire extinguishing compound containing means.

20. A method of extinguishing fires comprising the steps of:

mounting a plurality of canisters of fire extinguishing compound on a flexible matrix-like net;

connecting a detonating network to said canisters of fire extinguishing compound on said matrix-like net;

packing said matrix-like net and its associated components of said canisters of fire extinguishing compound and said detonating network in a stowage container;

deploying said matrix-like net, said canisters, and said detonating network from said container, through the air and to a burning site by rockets connected thereto; and rupturing said canisters of fire extinguishing compound by said detonating network.

21. A method according to claim 20 further comprising the steps of:

separating said canisters of fire extinguishing compound on said flexible matrix-like net in a spaced-apart relationship from one another;

connecting reinforced corners of said flexible matrix-like net to tow lines from rockets; and dispersing said fire-extinguishing compound from said canisters by said detonating network at said burning site during said step of rupturing.

22. A method according to claim 21 wherein the step of packing comprises the steps of:

longitudinally folding said matrix-like net in a series of longitudinally extending strips between top and bottom longitudinal folds;

stacking said longitudinally extending strips and said top and bottom longitudinal folds to lie adjacent one another;

laterally folding said stacked longitudinal strips and top and bottom longitudinal folds to create a series of laterally extending laterally folded strips between top and bottom lateral folds of said matrix-like net; and fitting said matrix-like net and its associated components together into a compact folded package in said container.

23. A method according to claim 22 wherein said step of longitudinally folding includes the step of:

successively rotating said matrix-like net in opposite rotational directions about successive longitudinal folds to place said longitudinal strips between said top and bottom longitudinal folds lying adjacent to one another in an accordion-like longitudinally extending stack; and said step of laterally folding includes the step of:

successively rotating said matrix-like net in opposite rotational directions about successive lateral folds to place said lateral strips between top and bottom lateral folds lying adjacent to one another in an accordion-like laterally extending stack.

24. A method according to claim 21 wherein the step of packing comprises the steps of:

laterally folding said matrix-like net in a series of laterally extending strips between top and bottom lateral folds;

stacking said laterally extending strips and said top and bottom lateral folds to lie adjacent one another;

longitudinally folding said stacked lateral strips and top and bottom lateral folds to create a series of longitudinally extending longitudinal folded strips between top and bottom longitudinal folds of said matrix-like net; and fitting said matrix-like net and its associated components together into a compact folded package in said container.

25. A method according to claim 24 wherein said step of laterally folding includes the step of:

successively rotating said matrix-like net in opposite rotational directions about successive lateral folds to place said lateral strips between said top and bottom lateral folds lying adjacent to one another in an accordion-like laterally extending stack; and said step of longitudinally folding includes the step of:

successively rotating said matrix-like net in opposite rotational directions about successive longitudinal folds to place said longitudinal strips between top and bottom longitudinal folds lying adjacent to one another in an accordion-like longitudinally extending stack.

* * * * *